US012234600B2

(12) United States Patent
Garrone et al.

(10) Patent No.: US 12,234,600 B2
(45) Date of Patent: Feb. 25, 2025

(54) MACHINE FOR AUTOMATICALLY FEEDING FLATWORK ARTICLES

(71) Applicant: Girbau Robotics, Grésy sur Aix (FR)

(72) Inventors: Dominique Garrone, Aix les Bains (FR); Felix Mouton, Chambery (FR); Sylvain Duplouy, Brison Saint Innocent (FR)

(73) Assignee: GIRBAU ROBOTICS, Gresy sur Aix (FR)

( * ) Notice: Subject to any disclaimer, the term of this patent is extended or adjusted under 35 U.S.C. 154(b) by 347 days.

(21) Appl. No.: 17/787,349

(22) PCT Filed: Dec. 18, 2020

(86) PCT No.: PCT/EP2020/087026

§ 371 (c)(1),
(2) Date: Jun. 20, 2022

(87) PCT Pub. No.: WO2021/123169

PCT Pub. Date: Jun. 24, 2021

(65) Prior Publication Data

US 2023/0013252 A1 Jan. 19, 2023

(30) Foreign Application Priority Data

Dec. 20, 2019 (EP) ..... 19383159

(51) Int. Cl.
*D06F 67/04* (2006.01)
*D06F 67/10* (2006.01)

(52) U.S. Cl.
CPC ..... *D06F 67/04* (2013.01); *D06F 67/10* (2013.01); *B65H 2406/31* (2013.01); *B65H 2701/174* (2013.01)

(58) Field of Classification Search
CPC ..... D06F 67/04; D06F 67/10; B65H 5/062; B65H 5/085; B65H 7/02; B65H 11/007;
(Continued)

(56) References Cited

U.S. PATENT DOCUMENTS 3,414,997 A * 12/1968 Henry ..... D06F 67/04 38/143
3,553,863 A * 1/1971 Sostrom ..... D06F 67/04 38/143

(Continued)

FOREIGN PATENT DOCUMENTS

DE 3119574 A * 12/1982 ..... D06F 67/04
JP 2007092255 A * 4/2007

(Continued)

*Primary Examiner* — Gregory W Adams
(74) *Attorney, Agent, or Firm* — Robert J. Hess; Hess Patent Law Firm

(57) ABSTRACT

Machine for feeding flatwork articles to an ironer-dryer machine, the machine including loading posts (1) with a load conveyor (2) for loading flatwork articles (53); one pair of transferring grippers (6) at each loading post (1), two or more spreading grippers (7) at a pickup station movable along one transverse guide (8); an outgoing feed conveyor (9) to transfer the flatwork article (53); and a vacuum chamber (44) below the spreading grippers (7) and below conveyor (9). The spreading grippers (7) are independent of each other, to spread a flatwork article (53) at several different zones with regard to the conveyor (9), operative in one or more lanes. A suction entrance (45) of vacuum chamber (44) has associated movable separating blades (59) temporally preventing insertion of a spread flatwork article (53) into vacuum chamber (44) and a controller coordinates the movements of the transferring grippers (6), spreading grippers (7) and separating blades (59).

15 Claims, 13 Drawing Sheets

(58) Field of Classification Search
CPC ..... B65H 43/00; B65H 2406/31; B65H 2511/40; B65H 2701/11; B65H 2701/174
See application file for complete search history.

(56) References Cited

U.S. PATENT DOCUMENTS

| | | | | | |
|---|---|---|---|---|---|
| 4,967,495 | A * | 11/1990 | Weir | ..... | D06F 67/04 38/143 |
| 5,515,627 | A * | 5/1996 | McCabe | ..... | D06F 67/04 38/143 |
| 7,380,356 | B2 * | 6/2008 | Baboz | ..... | D06F 67/04 38/143 |
| 9,657,434 | B2 * | 5/2017 | Garrone | ..... | D06F 67/10 |
| 10,829,887 | B2 * | 11/2020 | Lundt | ..... | D06F 67/04 |
| 2019/0301081 | A1 * | 10/2019 | Nakamura | ..... | D06C 3/00 |

FOREIGN PATENT DOCUMENTS

| | | | | | |
|---|---|---|---|---|---|
| WO | WO-2017153511 | A1 * | 9/2017 | ..... | D06C 3/00 |
| WO | WO-2018059730 | A1 * | 4/2018 | ..... | D06F 67/04 |
| WO | WO-2018105363 | A1 * | 6/2018 | ..... | D06C 3/00 |

* cited by examiner

MACHINE FOR AUTOMATICALLY FEEDING FLATWORK ARTICLES

TECHNICAL FIELD

The present invention generally relates to a machine for automatically feeding flatwork articles, that is laminar cloth articles such a quadrangular bed sheet to a subsequent article cloth processing machine such as an ironer-dryer machine.

BACKGROUND OF THE INVENTION

EP 3578702A1 (Purex) refers to a cloth spreading apparatus capable of lessening burden of the operators and reducing operation time, the apparatus comprising several cloth loading posts and for each of them a pair of feeding clamps, a moving device for moving the pair of feeding clamps between a feeding position where adjacent corners of a cloth are manually placed into the feeding clamps by an operator and a delivery position of the cloth and a spreading clamps for directly or indirectly receiving the cloth from the pair of feeding clamps and spreading the cloth in a direction of separating the adjacent corners from each other, wherein the moving device has a separate moving trajectory corresponding to each of the feeding clamps and the pair of feeding chucks are constructed so as to move independently of each other between the feeding position and the delivery position.

WO 9603540A2 (Chicago Dryer) discloses an apparatus for feeding flatwork articles to an outgoing feed conveyor, including a transfer mechanism to grip a leading-edge portion of a flatwork article between leading corner portions thereof and move the article from a loading station to a pickup station. A positioning device is provided to locate a trailing edge portion of the article at the pickup station for engagement with a moving mechanism, that grips said trailing edge portion of the article moving the article to a pickup station provided with spreading grippers, the outgoing feed conveyor having a front end located below the spreading grippers and a conveying surface movable in the feed direction to transfer the flatwork article to into an ironer.

Unlike the EP3578702 device, the solution described in the WO 9603540A2 by automatically locating the trailing corner portions of the sheet for pickup by a moving mechanism, an operator loading the flatwork article such as a bed sheet does not have to locate the side edge or the corner portions thereof. Moreover, the operator does not have to manually clamp the corner portions directly to a pair of clamps or locate and press a conventional button or the like to initiate processing of the sheet. Thus, a simple, compact loading and transferring apparatus is provided which increases the speed at which a single operator can load sheets for accurate placement onto a feed conveyor.

EP1683908 (Société Jean Michel) describes a device for transferring laundry to server clamps where two loaders move around a horizontal axis to a transfer position in the area where the laundry is tensioned. The apparatus also includes a suction device having a suction mouth adjacent to a lower part of the reception end of a conveyor belt to attract the flat article of clothing by means of a suction jet towards said reception end of the conveyor belt and towards a longitudinal introducer roller located next to a lower edge of said suction mouth. Said longitudinal roller is driven to rotate so as to cooperate with the suction device and quickly drag the hanging part of the article of clothing into a box of the device from where the article of clothing is dragged by the conveyor belt while mobile brushes moving longitudinally in divergent directions next to the suction mouth remove any possible wrinkles from the article of clothing.

EP3301218A1 (Kannegiesser) describes a laundry engagement device and corner search based on a similar technical principle as WO 9603540.

During the feed process carried out by the feeding machines as the ones previously disclosed protruding corner portions of the flatwork textile articles are usually formed at one side of a clamping pinch of the spreading clamps. Said protruding corner portions primarily give rise to so-called ear formations when the front edge of the flatwork textile article is stretched by the spreading clamps. Said ear formations negatively impact the quality of the flatwork textile article once transferred to the outgoing feed conveyor.

In WO2018059730A1 (Kannegiesser) to avoid the problem of the ear formation proposes a mechanism of rollers included in the clamps of a positioning device as disclosed in WO 9603540 to move the respective corner region of the laundry within the clamp so that the flatwork article is gripped by points close to the corners.

Patent application EP3663458A1 (Girbau Robotics) discloses an alternative mechanism wherein the clamping members are a pair of clamp assemblies coupled to the transverse guides and arranged to grasp corner portions of two contiguous corners of the flatwork textile article delivered thereto, and driving elements operatively connected to move the clamp assemblies along the transverse guides in opposite directions to spread the flatwork textile article in order to deposit it on an outgoing feed conveyor. All the devices and apparatus of the referred antecedents where it is not necessary for an operator to manually arrange the corners into clamps at the loading posts have gripper systems that come to pick up the corners presented by the workstation once located and transfer the flatwork articles to the spreading grippers via the centre part of the machine where the flatwork articles are centred in relation to an outgoing feed conveyor, extended and smoothed by known unwrinkling brushes.

US20150071736 discloses a method of transferring a piece of cloth and a laundry apparatus for performing the method in which a vacuum boom being divided into two or more sections that are connected to each other by means of hinges and are carried and controlled by mechanisms configured therefor.

The present patent application proposes a machine with a plurality of loading posts each of them including a load conveyor configured to transfer a leading-edge portion of a flatwork article between leading corner portions thereof to a rear delivery unit including a location mechanism to locate trailing corner portions of the flatwork article according to the state of the art for example as disclosed in WO9603540A2, but simplifying the transfer of the flatwork articles to the spreading grippers and speeding up this transfer. To this aim each of the loading posts has one pair of transferring grippers associated to the respective rear delivery unit and therefore the spreading grippers receive the laundry in front of each loading station from the transferring grippers and then can expand it in the centre or in a lateral area with regard to an outgoing feed conveyor, i. e. they can operate in one or more lanes.

Moreover, to assist in the operation in a central o side area a suction mouth and introducer roller extends all along the outgoing feed conveyor and have associated at least two movable elements that temporally prevent the insertion of a spread piece of clothing hanging from the transferring grippers or from the spreading grippers into the suction mouth.

BRIEF DESCRIPTION OF THE INVENTION

The present invention contributes to overcome the above and other drawbacks by providing a feeding machine for feeding quadrangular flatwork articles such a bed sheet to a subsequent article treatment machine, wherein the feeding machine includes in accordance with the state of the art, for example as disclosed by cited WO9603540, following elements:

- a plurality of loading posts each of the posts including a load conveyor comprising a conveying surface movable in a feed direction (D) configured to transfer a leading-edge portion of the flatwork article, between leading corner portions thereof to a rear delivery unit of said load conveyor, i.e., the operator does not need to introduce two corners of the flatwork articles into feeding clamps;
- a location mechanism being associated to the rear delivery unit of each loading post configured to automatically locate trailing corner portions of the flatwork article;
- a pair of transferring grippers, movable between a receiving position, adjacent to the rear delivery unit for engagement with the trailing corner portions of the flatwork article located by the location mechanism, and a transfer position spaced apart from the receiving position in the feed direction (D);
- a pickup station including at least two spreading grippers which are movable along at least one transverse horizontal guide perpendicular to the feed direction (D) between a waiting position adjacent to said transfer position of the transferring grippers, for receiving and griping the trailing corner portions of the flatwork article and a spread position in which the spreading grippers are further separated from each other than in the waiting position;
- an outgoing feed conveyor having a front end located below the spreading grippers and a conveying surface movable in the feed direction (D) to transfer the flatwork article into an ironer-dryer machine;
- a vacuum chamber connected to a vacuum source, located below the spreading grippers and below the front end of the outgoing feed conveyor and having a suction entrance to the vacuum chamber arranged at a distance of a leading edge of said outgoing feed conveyor, and
- an introducer roller parallel to the front end of the outgoing feed conveyor being rotated by a motor in a load direction and being arranged adjacent the suction entrance; According to this invention the spreading grippers are mobile independently of each other over the entire width of the transverse horizontal guide, so that they can spread a flatwork article at several different zones with regard to the outgoing feed conveyor into which the flatwork article is to be deposited. In this way the flatwork article can be centred in correspondence with a central zone of the outgoing feed conveyor or in correspondence with one lateral zone thereof, allowing to operate in one or more lanes. In a further embodiment the spreading grippers comprises three or more grippers independent of each other. As each of the posts includes its own transferring gripers, this allows the grippers to access the different loading post more quickly and to pick up the flatwork articles from different loading post and download them to the outgoing feed conveyor in a more efficient way.

In order to achieve this, it has been planned that the suction entrance of the vacuum chamber extends all along the outgoing feed conveyor and has associated thereof two or more movable separating blades that temporally prevent the insertion of a spread flatwork article such as piece of clothing, into the suction entrance, in correspondence with any of the above-mentioned several different zones, where the unloading of the flatwork articles can take place towards the conveying surface of the outgoing feed conveyor.

The machine includes a controller that coordinates the movements of the transferring grippers, spreading grippers and movable separating blades.

Further aspects of the invention concern to an introducer roller arranged parallel to the front end of the outgoing feed conveyor and adjacent the suction entrance of the vacuum chamber, the introducer roller extending all along the whole outgoing feed conveyor width and being rotated by a motor in a load direction by which an uncovered upper surface of the introducer roller moves towards the suction entrance so that when a portion of the flatwork article suspended in the spreading grippers contacts with upper surface of the introducer roller is dragged toward the suction entrance.

In an embodiment each separating blade is moved in a vertical direction upwardly to position itself between the flatwork article and the introducer roller in order to prevent contact between these two elements during a first step of transfer of the flatwork article towards the outgoing feed conveyor and that moves downward in a second step of the transfer when the flatwork article is to be transferred so that a free end portion of the spread flatwork article encounters the introducer roller and enters the vacuum chamber. An actuator provides these up and down movements of the separating blade.

In correspondence with each of the separating blades the vacuum chamber further includes a member driven by an actuator that temporally reduces the suction in the vacuum chamber obstructing substantially the vacuum chamber section.

The cited controller provides a synchronisation between movements of each separating blade and member to temporally reduce u obstruct the suction in the vacuum chamber, and further provides a coordination between the movement of the different separating blades to operate separately or to operate in conjunction depending on the zone where the flatwork article is centred.

In an embodiment the feeding machine of this invention is further equipped with an auxiliary device placed in superposition to the loading end of outgoing feed conveyor including a roof plate configured to be driven away from the surface of the feed conveyor or close to it allowing a controlled passage of the flat clothing article extended on said outgoing feed conveyor, as known by EP2977505A1 of the same applicant, but in this embodiment the auxiliary device extending transverse to the loading direction of the flatwork article on said outgoing feed conveyor and being divided in two independent parts, each of said parts having own driving means, in correspondence with the two movable separating blades.

Besides, the cited controller further provides a synchronisation between movements of each separate blade and independent parts of the auxiliary device, so that contributing to operate alternately in one or more lanes and allow to deposit the flatwork article on one half or the other half of the outgoing conveyor.

Also, to avoid wrinkles in the bed sheet before it being transferred onto the outgoing feed conveyor two side unwrinkling endless brush belts extending around vertical outer side pulleys and vertical inner side pulleys have been provided.

The transfer system of each loading station comprises one pair of transferring grippers wherein jaws of each transferring gripper are mounted on a pivot arm pivotable about a pivot axis, the pivot axes being parallel to each other determining that movement of both pivot arms are coplanar, and the transferring grippers describe circular arc paths in opposite directions when moving between a receiving position below corner-gripping nip rollers that retain end portions of a bed sheet and a transfer position. These circular arc paths determine that the gripped portions of the flatwork article are moved away, i.e., the piece of clothing is transversally extended a certain degree while it is transferred.

In a preferred embodiment the pivot axis of the jaws of each transferring gripper is oriented in a vertical direction and the circular arc paths described by the transferring grippers when moving between the receiving position and the transfer position are comprised in a horizontal plane.

In an embodiment of this invention the referred transfer system further comprises:

- a load conveyor comprising a conveying surface movable in a feed direction, a front reception unit and a rear delivery unit
- one pair of guiding channels are located at either side of the rear delivery unit of the load conveyor, the guiding channels having respective rear delivery ends;
- two pairs of corner-gripping nip rollers located adjacent to the rear delivery ends of the guiding channels; and
- one pair of transferring grippers movable between a receiving position adjacent to the corner-gripping nip rollers and a transfer position spaced apart from the receiving position in the feed direction, the transferring grippers having jaws movable between open and closed positions.

The machine further includes two corner-detecting sensors each arranged so as to detect the presence of a rear corner of a flatwork article in a space adjacent gripping nip rollers.

According to this invention the outgoing feed conveyor has a feed conveyor width greater than the load conveyor width of each loading post and the transverse horizontal guide has a guide length equal or greater than the outgoing feed conveyor width.

Further details of the invention will be exposed in the following.

BRIEF DESCRIPTION OF THE DRAWINGS

The above features and advantages will be better understood from the following detailed description of a preferred embodiment with reference to the accompanying drawings, in which.

DETAILED DESCRIPTION OF A PREFERRED EMBODIMENT

Figure 1:
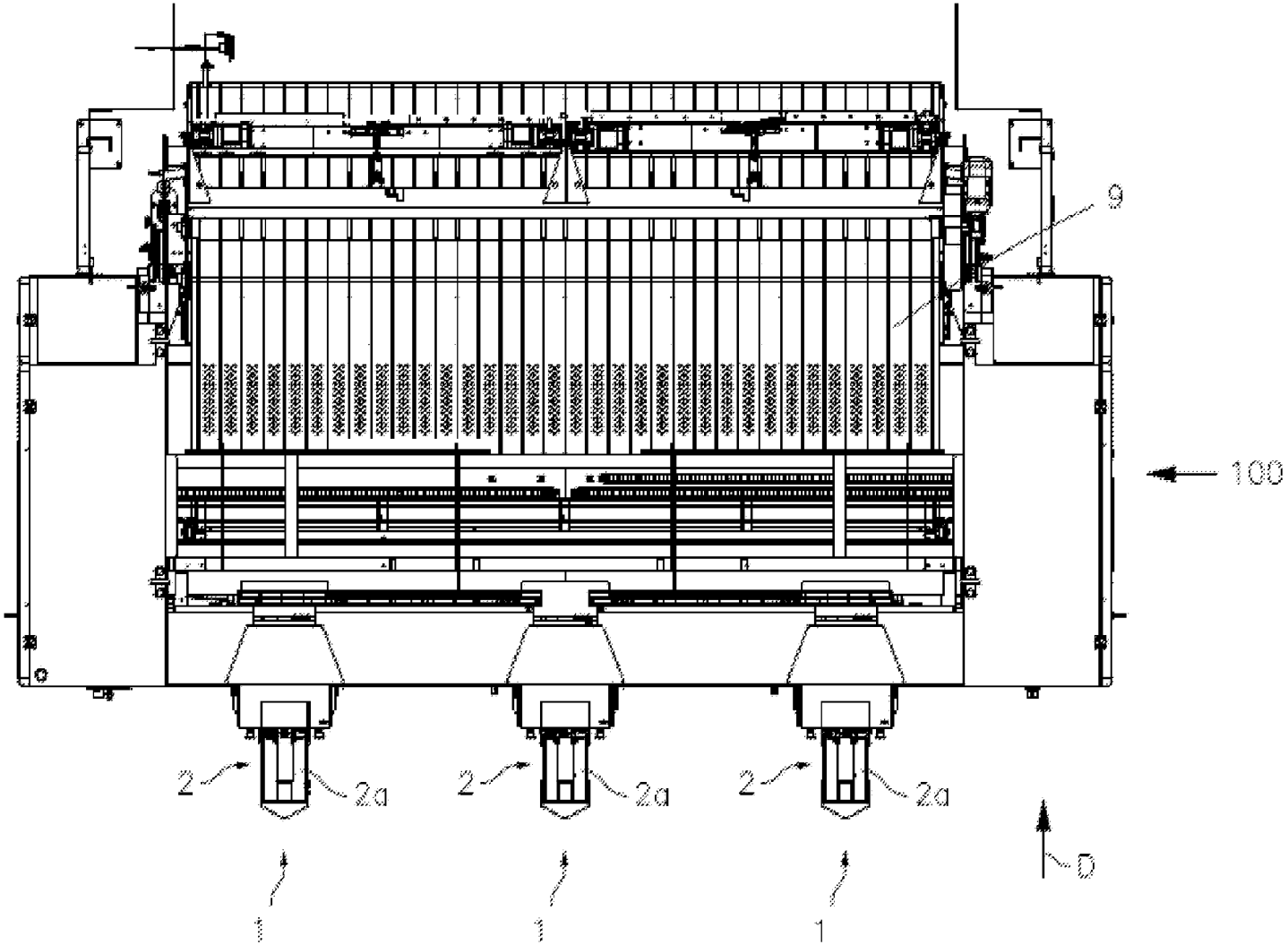
FIG. 1 is a top view of a feeding machine for feeding quadrangular bed sheets according to an embodiment of the present invention including three loading posts.

Firstly, with regard to FIG. 1, the reference sign 100 generally designates a feeding machine intended for feeding quadrangular flatwork articles 53 such as bed sheets to a subsequent cloth processing machine such as an ironing-dryer machine (an outgoing feed conveyor 9 of said subsequent cloth processing machine is shown in FIGS. 1, 7, 11*a* to 11*c*). In the illustrated embodiments the feeding machine 100 includes three loading post 1 for loading for example, quadrangular bed sheets manually introduced at a front reception area of each loading post by an operator gripping a leading-edge portion of the bed sheet between leading corner portions thereof.

Figure 2:
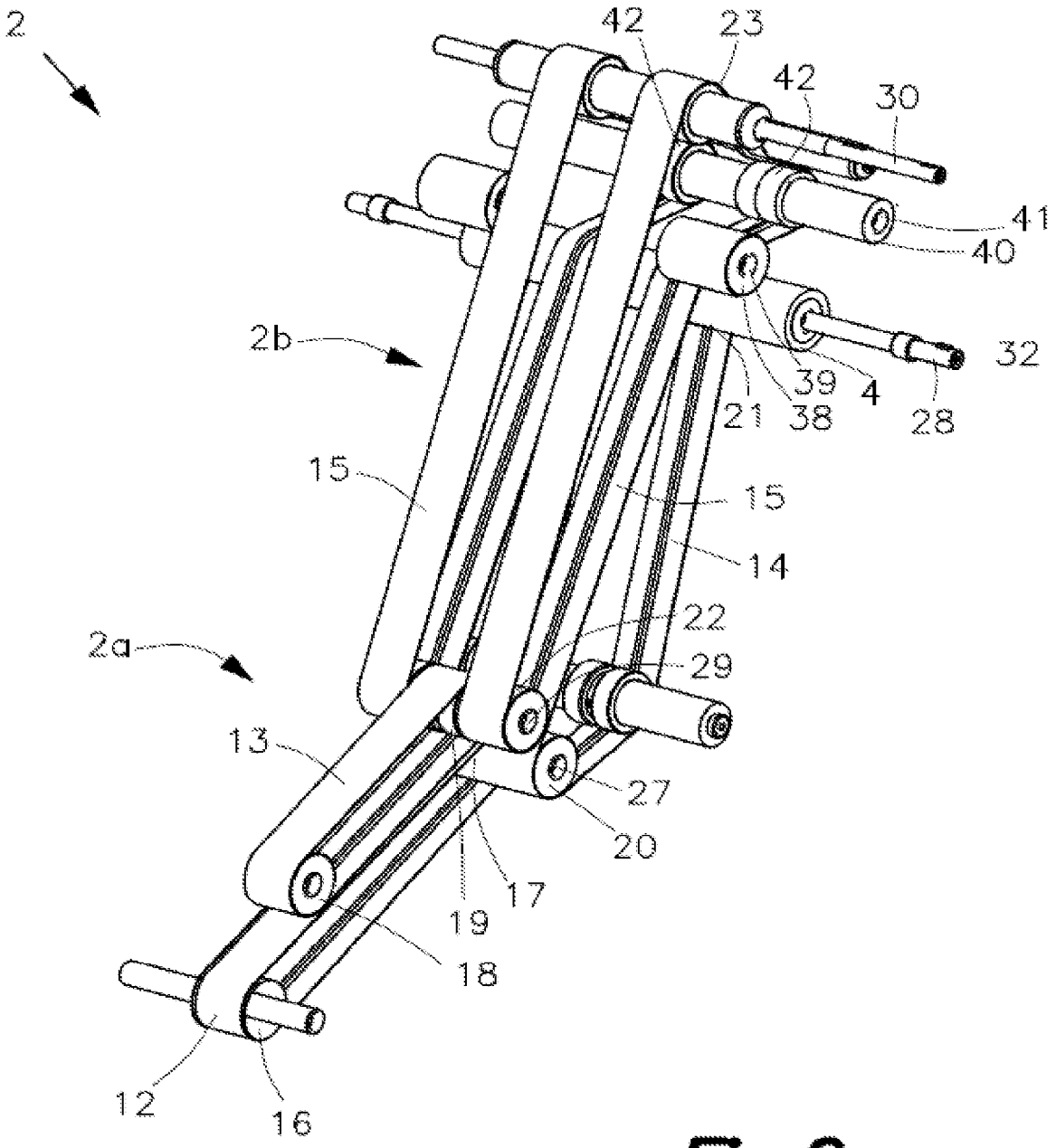
FIG. 2 is a perspective view of a load conveyor and corner-gripping nip rollers belonging to each loading post of the feeding machine of FIG. 1.
Figure 3:
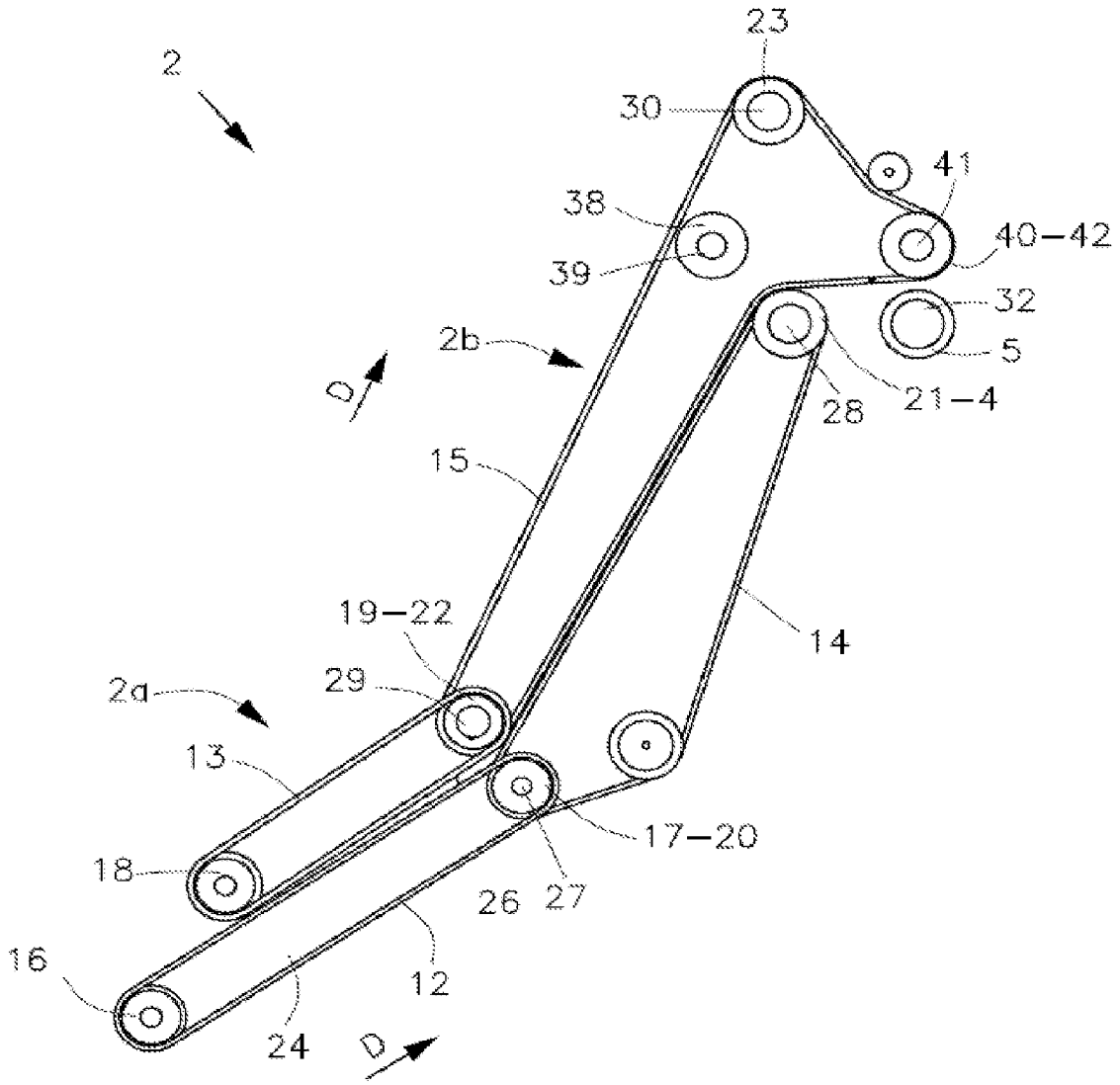
FIG. 3 is a diagrammatic side view of the load conveyor and corner-gripping nip rollers of FIG. 2 and elements associated therewith.

FIGS. 2 and 3 show a diagrammatic perspective and a side views, respectively, of the load conveyor 2 that consist of two parts, a front reception unit 2*a* and a rear delivery unit 2*b*.

The front reception unit 2*a* comprises a lower reception endless belt 12 extending around a horizontal lower reception front pulley 16 and a horizontal lower reception rear pulley 17; and an upper reception shorter endless belt 13 extending around a horizontal upper reception front pulley 18 and a horizontal upper reception rear pulley 19. The leading edge of a bed sheet is conveyed clamped between the lower reception endless belt 12 and the upper reception endless belt 13

The rear delivery unit 2*b* comprises two lower delivery endless belts 14 extending around respective horizontal lower delivery front pulleys 20 and respective horizontal lower delivery rear pulleys 21, and two upper delivery endless belts 15 extending around respective horizontal upper delivery front pulleys 22 and respective horizontal upper delivery rear pulleys 23, the lower delivery rear pulleys 21 are at a higher level than the lower delivery front pulleys 20 and the upper delivery front pulleys 22.

Each lower delivery endless belt 14 is paired with one of the upper delivery endless belts 15 and both have respective drag sections which continue to clamp the leading edge of the bed sheet and said drag sections facing each other and move in the feed direction D.

The pairs of lower and upper delivery endless belts 14, 15 are located at either sides of the pair of lower and upper reception endless belts 12, 13; and the lower delivery front pulleys 20 are coaxial with the lower reception rear pulley 17 and the upper delivery front pulleys 22 are coaxial with the upper reception rear pulley 19.

The lower reception rear pulley 17 and the lower delivery front pulleys 20 are rigidly attached to a lower front shaft 27, the lower delivery rear pulleys 21 are rigidly attached to a lower rear shaft 28. The horizontal upper reception rear pulley 19 and the upper delivery front pulleys 22 are rigidly attached to an upper front shaft 29.

The upper delivery rear pulleys 23 are rigidly attached to an upper rear shaft 30.

FIG. 3 also show two pairs of corner-gripping nip rollers 4, 5. The two pairs of corner-gripping nip rollers 4, 5 have respective parallel axes which lay in a horizontal plane when the movable corner-gripping nip roller 5 is in the grip position.

Figure 3A:
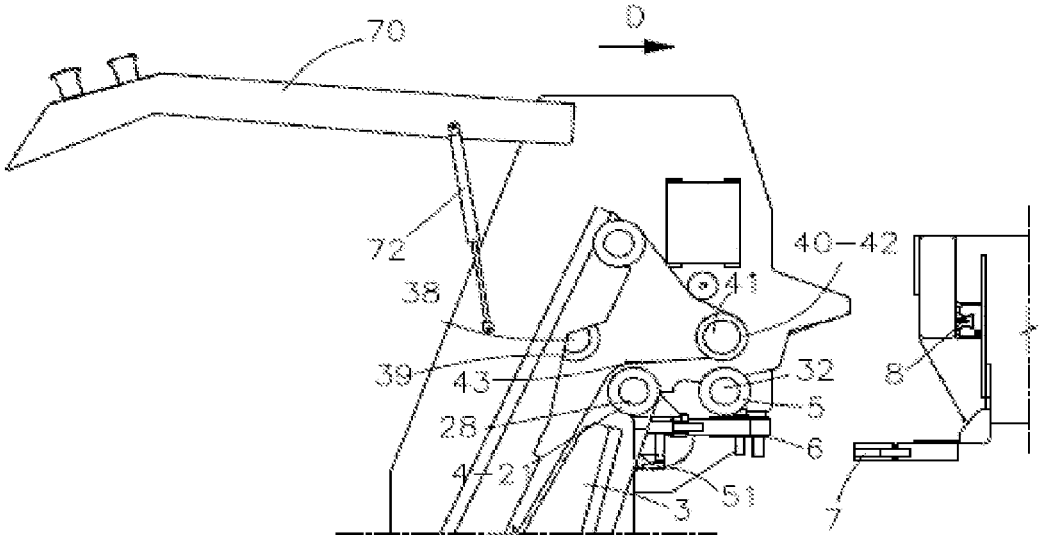
FIG. 3A is a partial detail of FIG. 3 showing the transferring grippers and the transversal guide of the spreading grippers, as well as a hood of each loading post.

FIG. 3A is a partial detail of upper region of FIG. 3, with the addition of the transferring grippers 6 and the spreading grippers 7 of the pickup station that are slidable mounted on a transversal guide 8. The figure also shows a hood 70 covering the rear delivery unit 2*b* which can be raised or lowered with for example a piston 72.

Also shown in this FIG. 3A is one of the two corner-detecting sensors 43, each arranged so as to detect the presence of a rear corner of a bed sheet in a space adjacent gripping roller 4.

Figure 4A:
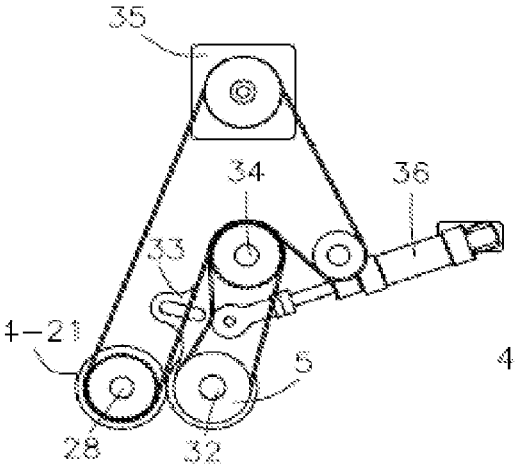
FIGS. 4A and 4B are diagrammatic side views of the corner-gripping nip roller in a nip position and a release position, respectively, as well of the actuating means thereof.
Figure 4B:
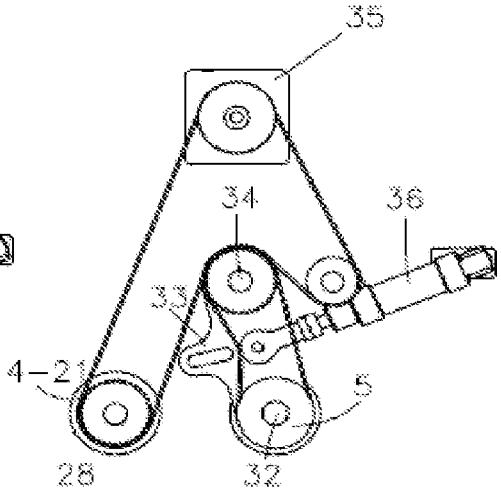

FIGS. 4A and 4B show a movable corner-gripping roller 5 parallel to the stationary corner-gripping roller 4 and rotary mounted on a roller shaft 32 fixed to a pivot arm 33 pivotally mounted on a pivot shaft 34. The stationary corner-gripping roller 4 is located adjacent to one of the lower delivery rear pulleys 21 of the rear delivery unit 26 and rotary mounted on the lower rear shaft 28.

The FIGS. 4A and 4B also show one single nip roller motor 35 that is operatively connected to rotate the stationary and movable corner-gripping rollers 4, 5 of each pair of corner-gripping nip rollers 4, 5 in opposite directions; and an arm actuator 36 is operatively connected to move the pivot arm 33 of each pair of corner-gripping nip rollers 4, 5 between a grip position (FIG. 4A), in which the movable corner-gripping roller 5 presses against the stationary corner-gripping roller 4, and a release position (FIG. 4B), in which the movable corner-gripping roller 5 is away from the stationary corner-gripping roller 4.

Figure 5:
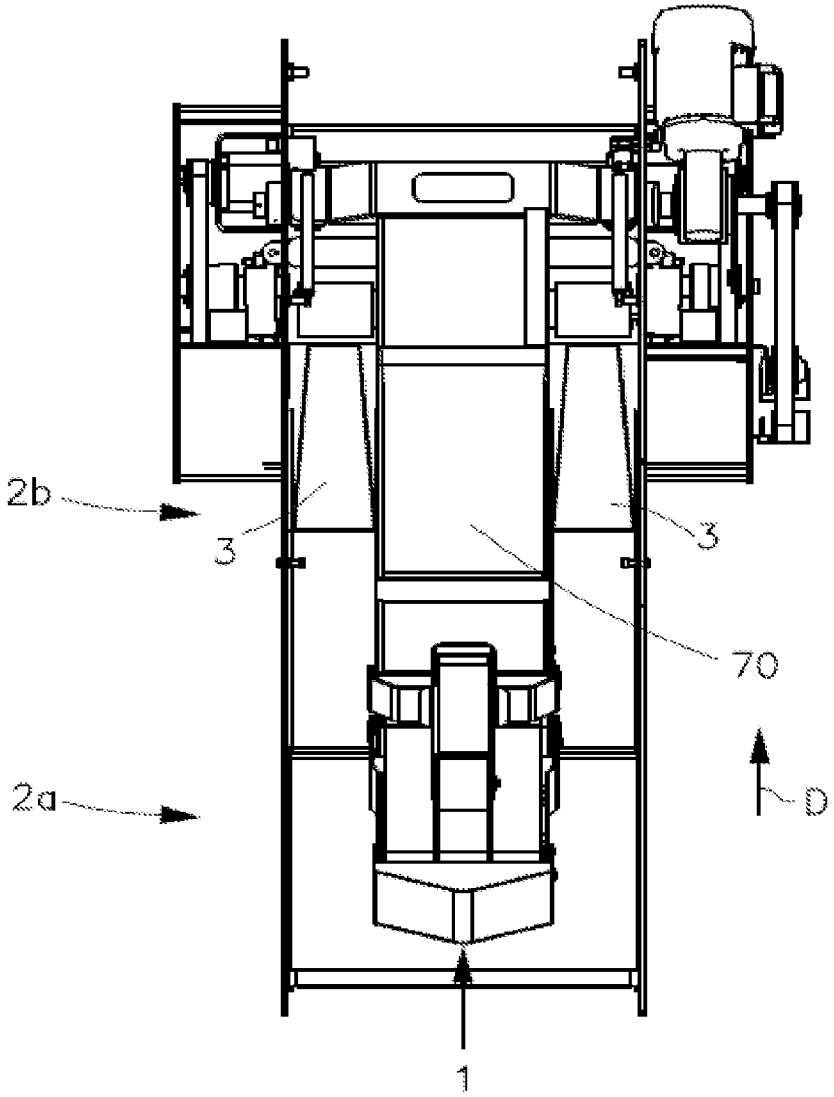
FIG. 5 is a front view of one of the loading posts with elimination of the hood of the upper part.

FIG. 5 is a front view of one of the loading posts showing a loading post 1 having a load conveyor comprising a conveying surface movable in a feed direction D, a front reception unit 2*a* and a rear delivery unit 2*b*. The loading post further comprises one pair of side guiding channels 3 for the lateral parts of the sheet, which hang hanging, the channels 3 being located on each side of the rear delivery unit 2*b* of the load conveyor 2, and the guiding channels 3 having respective rear delivery ends.

Figure 6A:
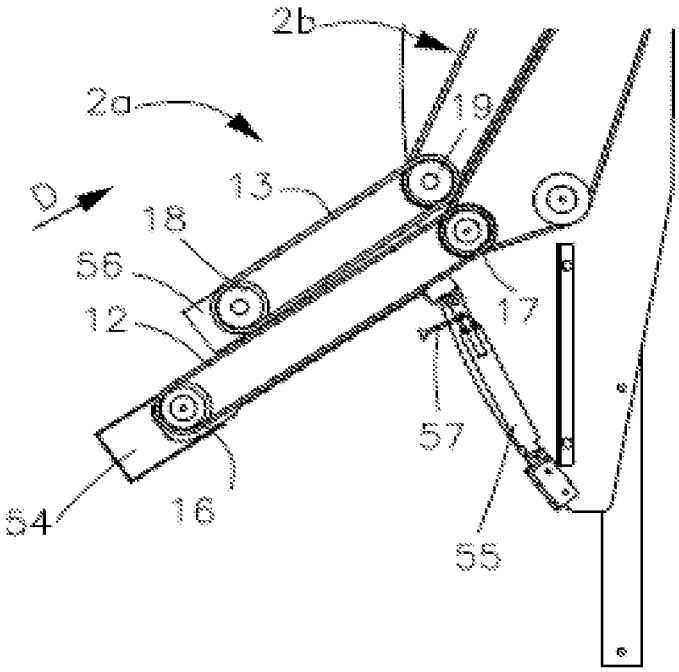
FIGS. 6A and 6B are diagrammatic partial side views of a front reception unit of the load conveyor in two different tilt positions thereof.
Figure 6B:
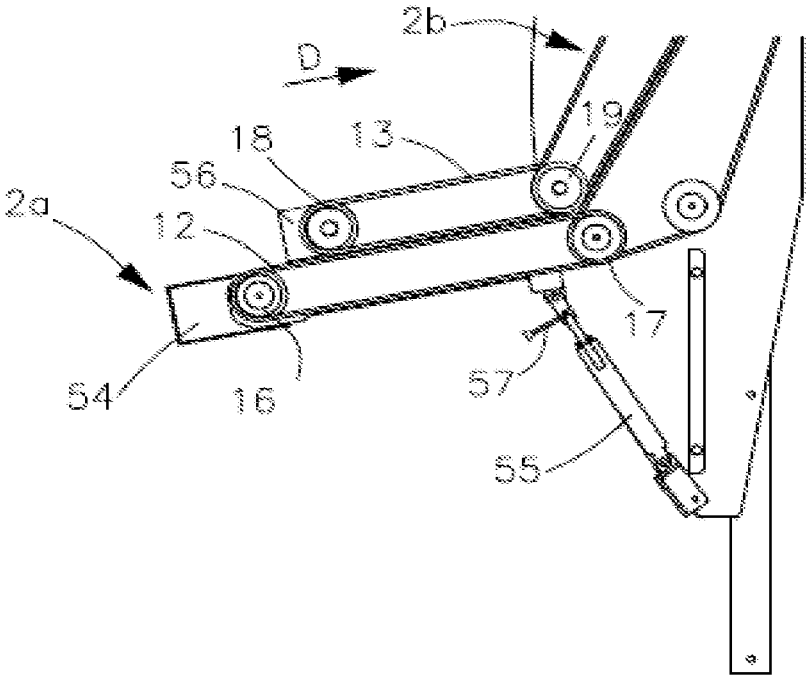

FIGS. 6A and 6B are diagrammatic partial side views of the front reception unit 2*a* of the load conveyor 2 in two different tilt positions thereof comprising a spring element 55 operatively connected to the lower tilting support 54 to bias the lower tilting support 54 to rotate upwards, the lower tilting support 54 being lockable in a desired tilt position by a locking device;

The FIGS. 6A and 6B also show the upper reception front pulley 18 that is mounted on an upper tilting support 56 pivotable about an axis coaxial with the upper reception rear pulley 19, the drag section of the upper reception endless belt 13 resting on the drag section of the lower reception endless belt 12 by gravity at any tilt position of the lower tilting support 54.

In the disclosed embodiment the spring element 55 is embodied as a gas spring cylinder including the locking device therein, the locking device being manually operable by a lever 57.

Figure 7:
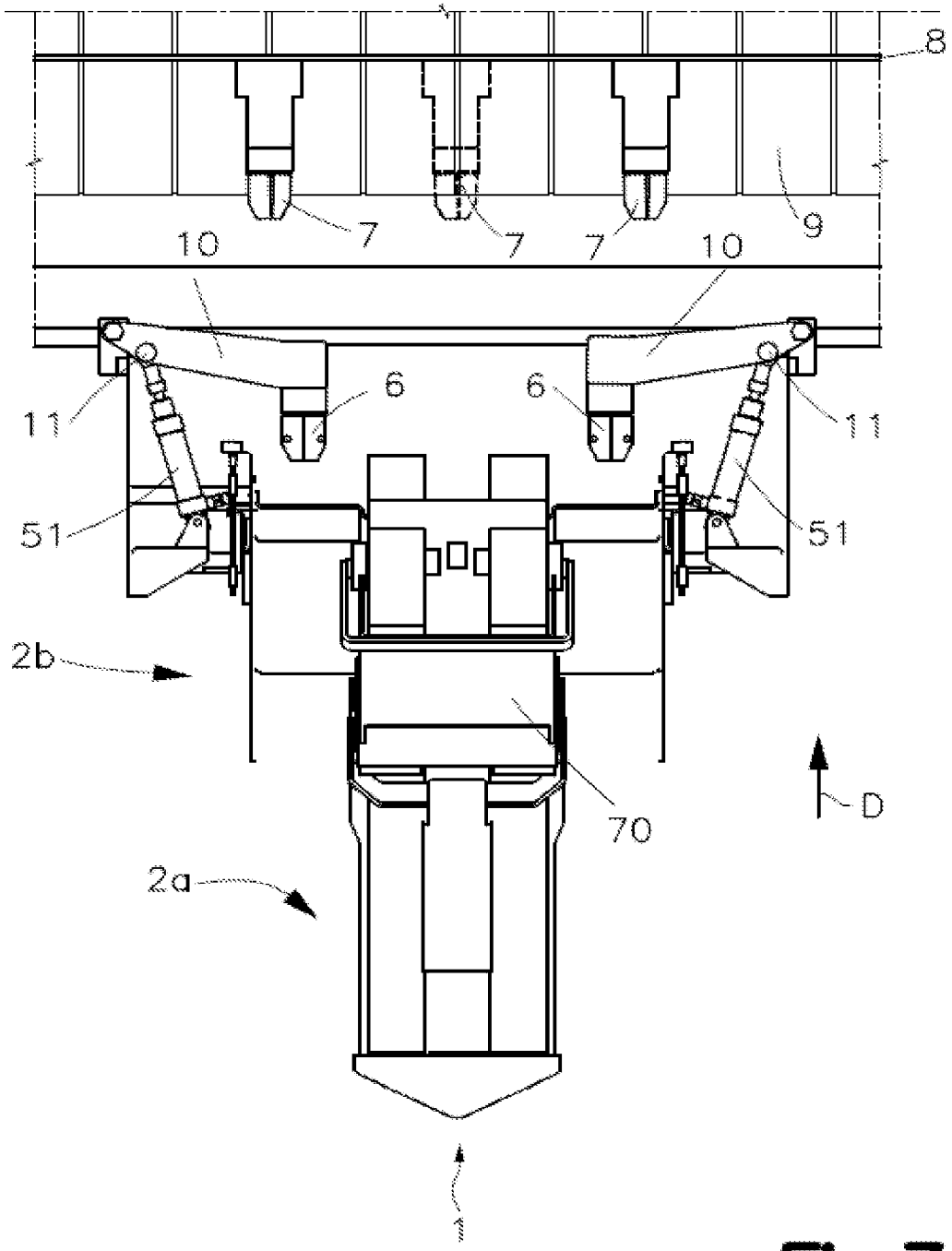
FIG. 7 is a simplified top view one of the loading posts having transferring grippers which cooperate with spreading grippers.

FIG. 7 shows a partial schematic top view of the loading post 1 of the FIG. 5 with elimination of a part of the hood 70 of the upper part; this view shows one pair of transferring grippers 6 movable between a receiving position and a transfer position spaced apart from the receiving position in the feed direction D, the transferring grippers 6 having jaws movable between open and closed positions.

FIG. 7 also illustrates one pair of spreading grippers 7 at the pickup station located at the pickup station that are movable arranged along one transverse horizontal guide 8 perpendicular to the feed direction D between a waiting position adjacent to the transfer position of the transferring grippers 6 and a spread position in which the spreading grippers 7 are more apart from each other, the spreading grippers 7 having jaws movable between open and closed positions.

In this FIG. 7 a third spreading gripper 7 has been indicated, located between the two spreading grippers 7, and this third spreading gripper is designed to operate with any one of the two other grippers in such a way that two pairs of grippers 7—operate by assisting at a given moment one of the right or left post loading or the central loading post and the other gripper 7 which is free, it enters to operate with the nearest gripper as soon as this last one has released a flatwork article.

The third gripper or in other embodiments a four gripper will be movable arranged along one or more transverse horizontal guides 8.

An outgoing feed conveyor 9 having a front end is located below the spreading grippers 7 and has a conveying surface movable in the feed direction D.

The jaws of each transferring gripper 6 are mounted on a pivot arm 10 pivotable about a pivot axis 11 and arranged to describe circular arc paths in opposite directions when moving between the receiving position and the transfer position due to the action of pneumatic cylinder 51. This means that when the flatwork article or flatwork article 53 held by two of its corners by the transferring grippers is transferred, those corners move away from each other, and the sheet is presented to the spreading grippers in a partially extended form.

Figure 8:
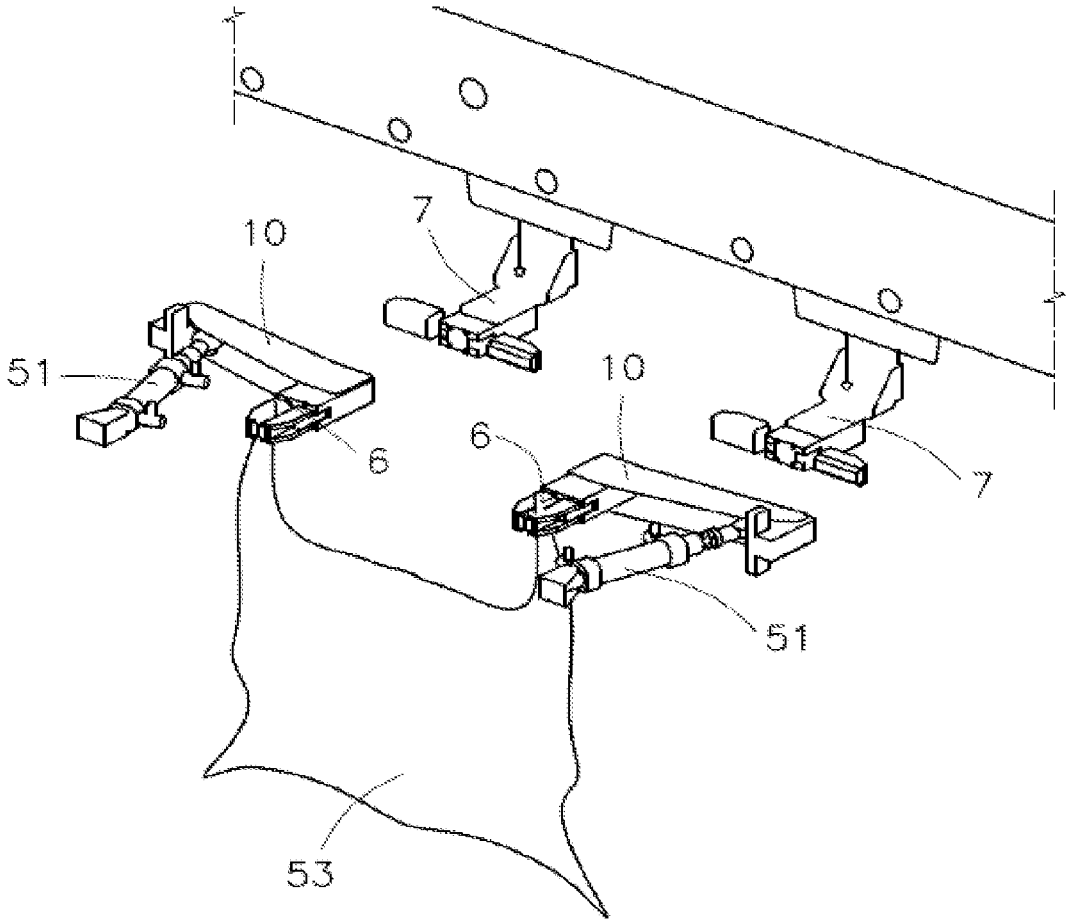
FIG. 8 is a partial perspective view of the transferring grippers and the spreading grippers, with the transferring grippers in a receiving position having taken the corners of a flatwork article.

In a preferred embodiment the pivot axles 11 for the transferring grippers 6 are vertical and the movement of both pivot arms 10 occur in a common horizontal plane i.e., the circular arc paths described by the transferring grippers 6 when moving between the receiving position and the transfer position are comprised in a horizontal plane. As previously indicated, this determine that the gripped portions of the flatwork article 53 are moved away, i.e., the piece of clothing is transversally extended a certain degree while it is transferred and when it is delivered to the spreading grippers 7. FIG. 8 is a partial perspective view of the transferring grippers 6 of the loading station and the spreading grippers 7 at the pickup position, with the transferring grippers 6 in a receiving position having a flatwork article 53 grabbed by two of its corners.

Figure 9:
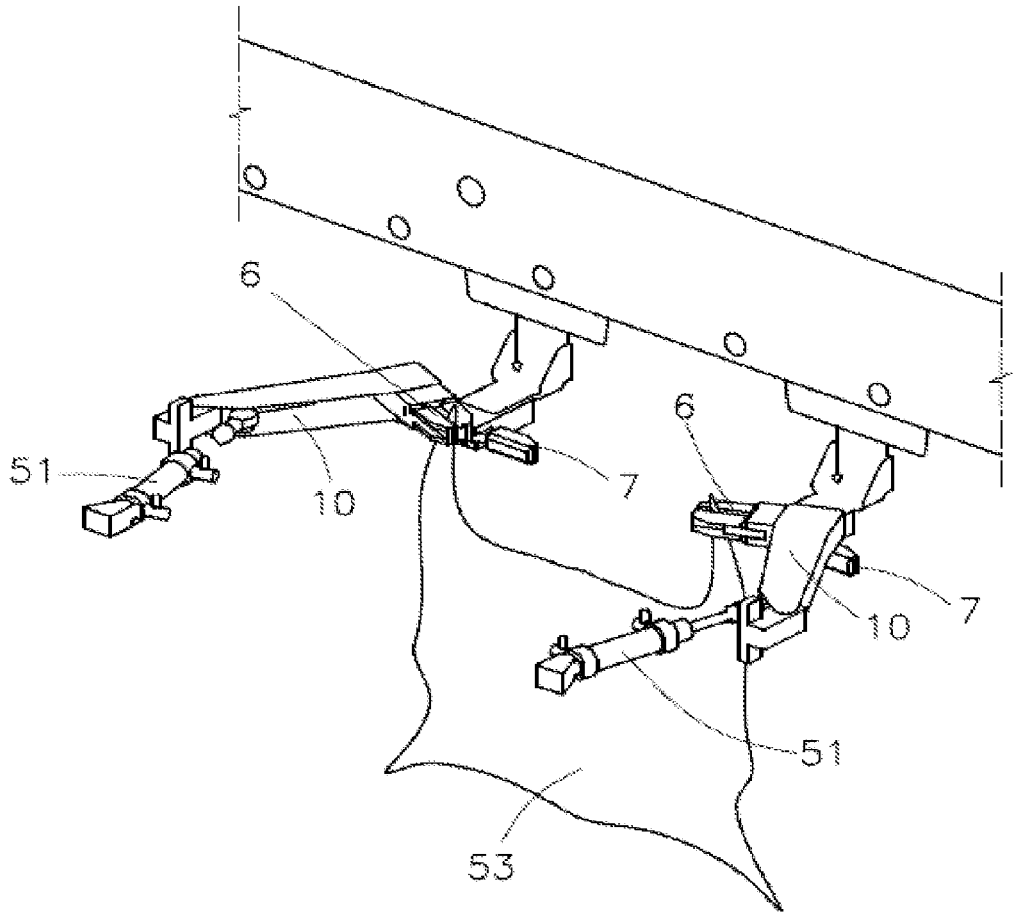
FIG. 9 is a partial perspective view of the transferring grippers and the spreading grippers, with the transferring grippers in a transfer position delivering the flatwork article to said spreading grippers.

FIG. 9 is a partial perspective view of the transferring grippers 6 and the spreading grippers 7, with the transferring grippers 6 in a transfer position delivering a flatwork article 53 to a pair of spreading grippers 7.

Figure 10:
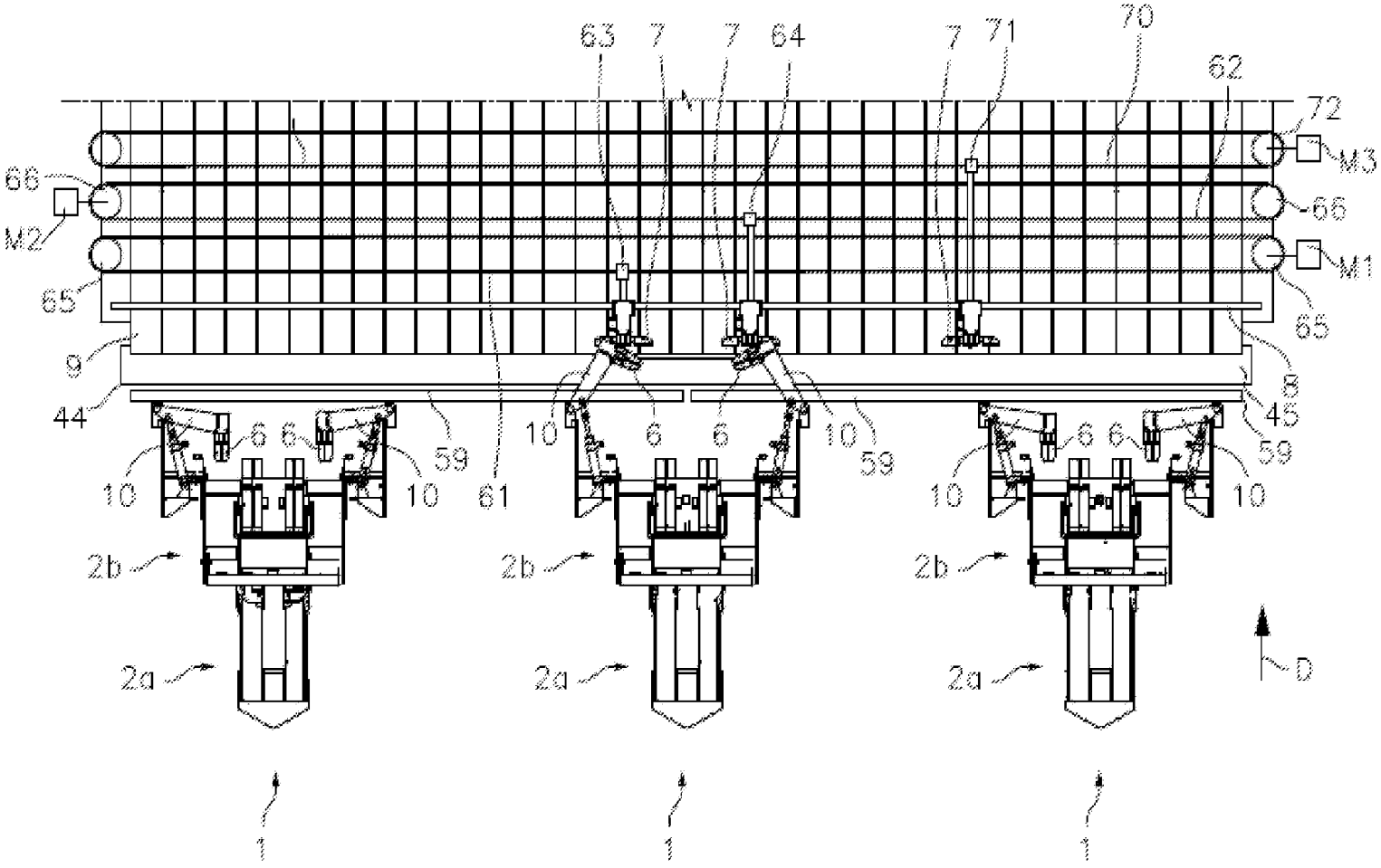
FIG. 10 is a top view of an embodiment of the feeding machine having three loading posts, including three independent spreading grippers and showing a part of the outgoing feed conveyor, with each loading post having the corresponding transferring grippers.

FIG. 10 is a top plan view of an embodiment of the feeding machine 100 with three loading posts 1, where it can be seen three spreading grippers 7 and the outgoing feed conveyor 9, with each loading post 1 having the corresponding pair of transferring grippers 6 and one of the loading posts 1 that is in the transfer stage of a flatwork article 53 to the spreading grippers 7.

According to one preferred embodiment of this invention the spreading grippers 7, in this example in number of three, are independent of each other, and each of the spreading grippers 7 is attached to a continuous belt 61, 62, 70 rotatable around end pulleys 65, 66, 72 and each of the belts 61, 62, 70 being rotated by a respective motor M1, M2, M3, the continuous belts 61, 62, 70 extending parallel to the transversal guide 8.

In this FIG. 10 it can also be seen that the suction entrance 45 of the vacuum chamber 44 extends all along the outgoing feed conveyor and in front of the suction entrance (45) two movable separating blades 59 are located, intended as previously explained to temporally prevent insertion of a spread piece of clothing placed before one of the separation blades, into the suction entrance 45.

Figure 11A:
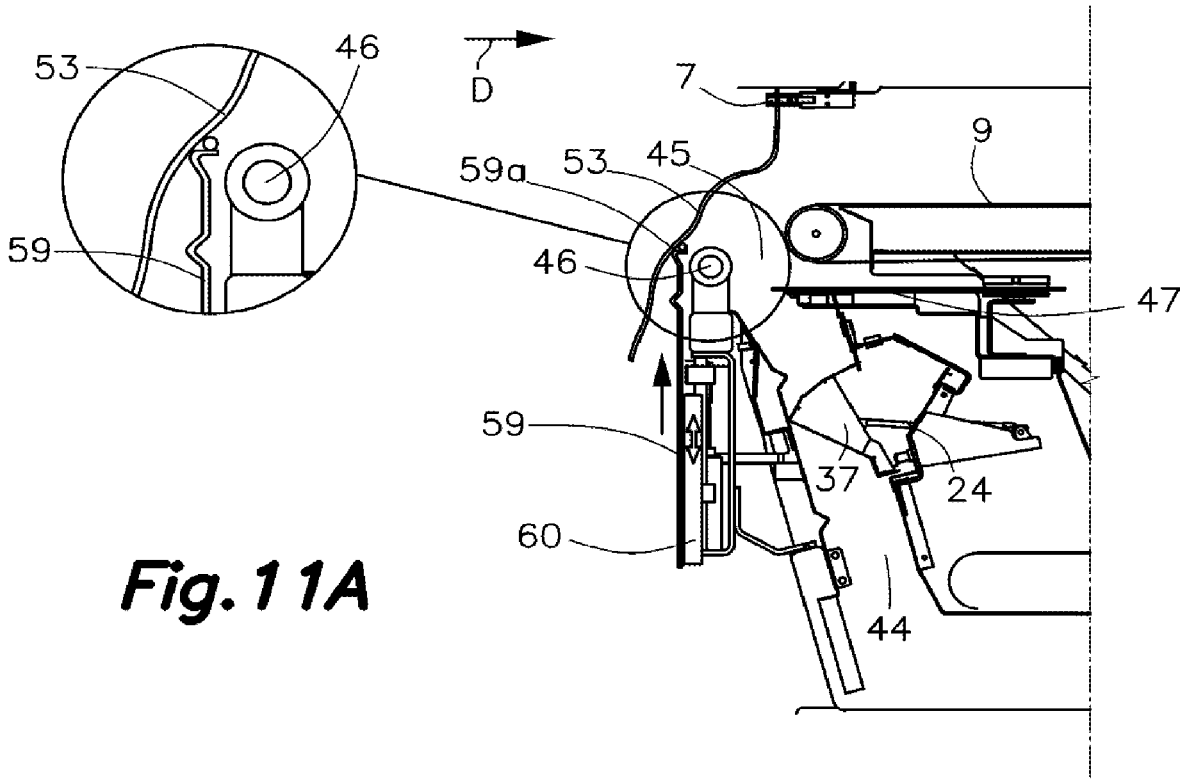
FIGS. 11A to 11C are diagrammatic sectional side views of the feeding machine in three different moments of the handling of a flatwork article, once spread out, being transferred onto the outgoing feed conveyor, involving operation of the separate blades, vacuum chamber and member to temporally obstruct said vacuum chamber
Figure 11B:
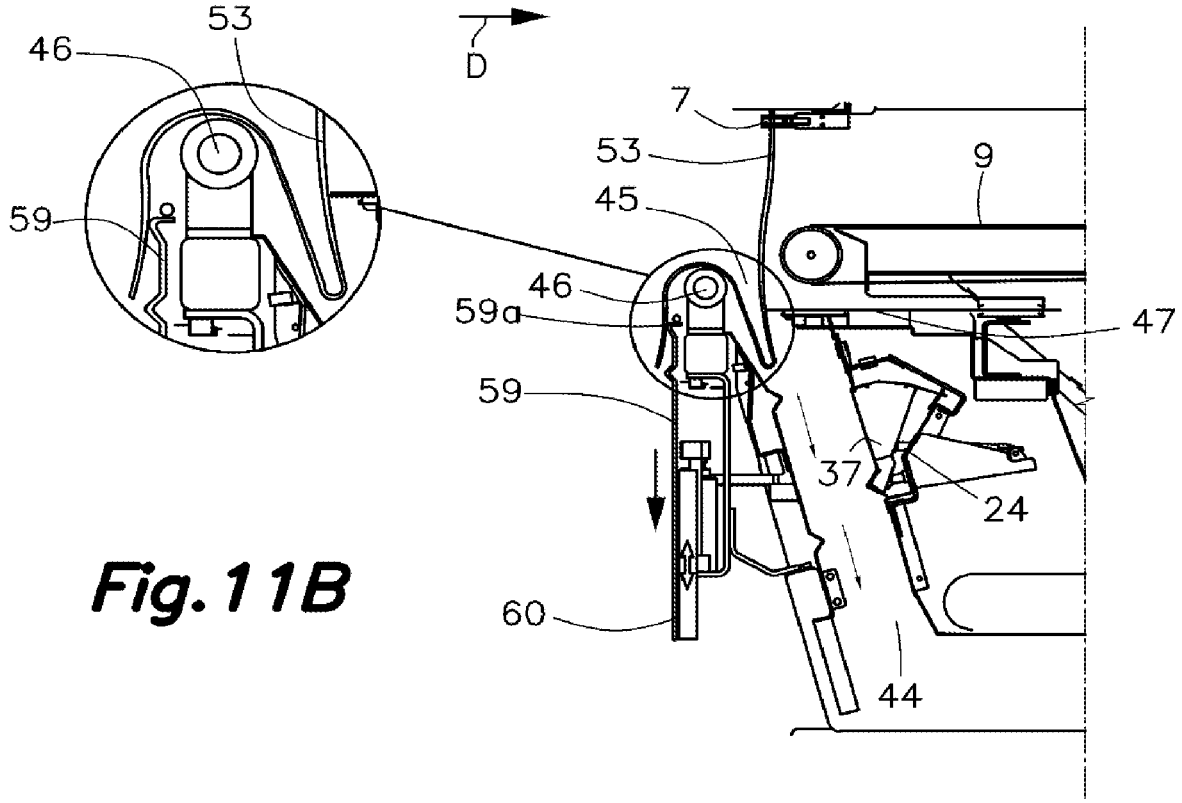
Figure 11C:
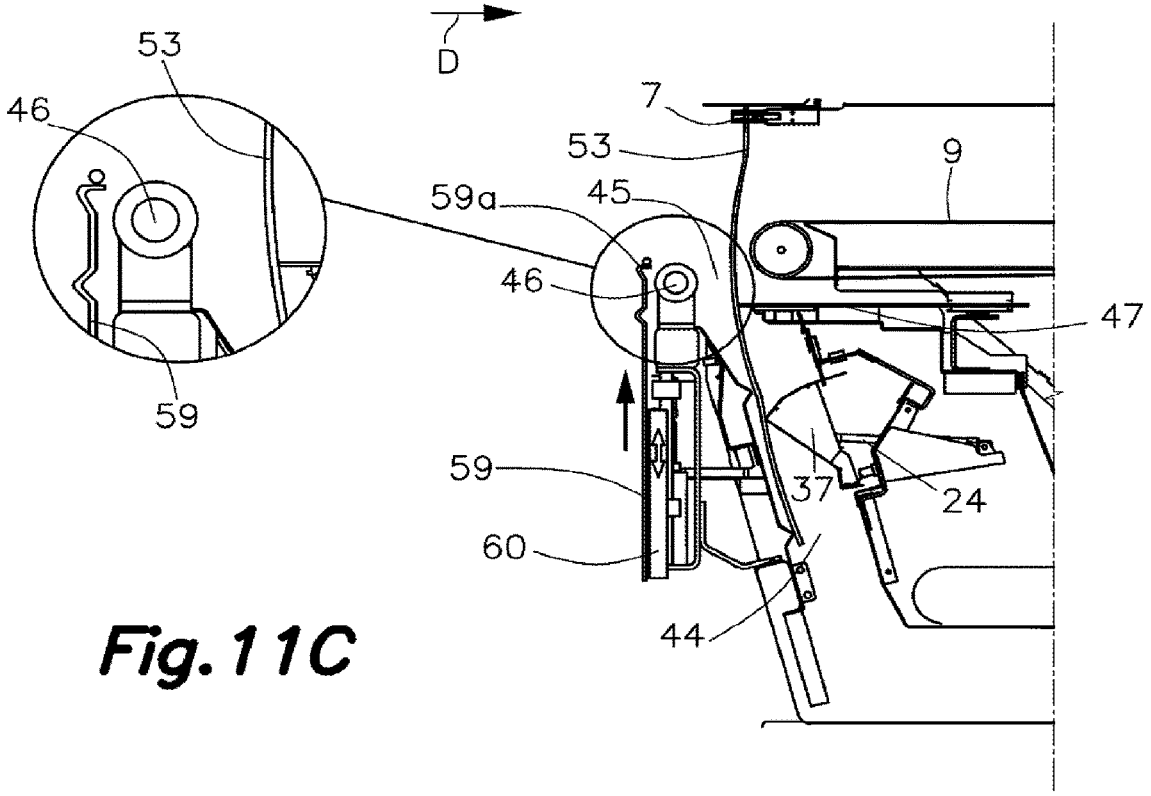
Figure 12A:
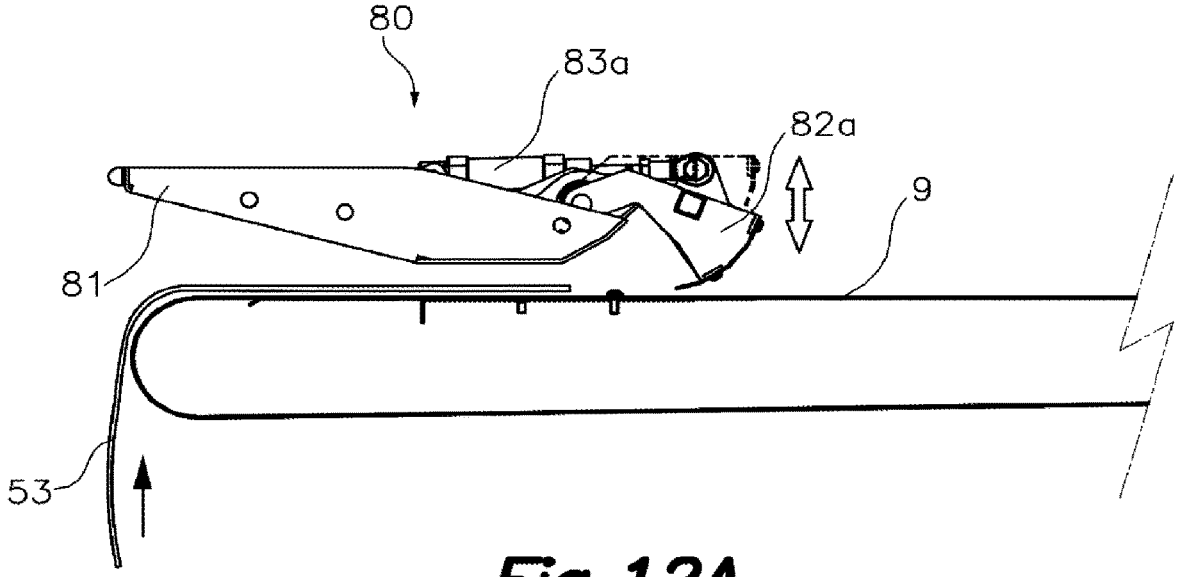
FIG. 12A is a side elevation view of an auxiliary device in an overlapping arrangement to the output conveyor.
Figure 12B:
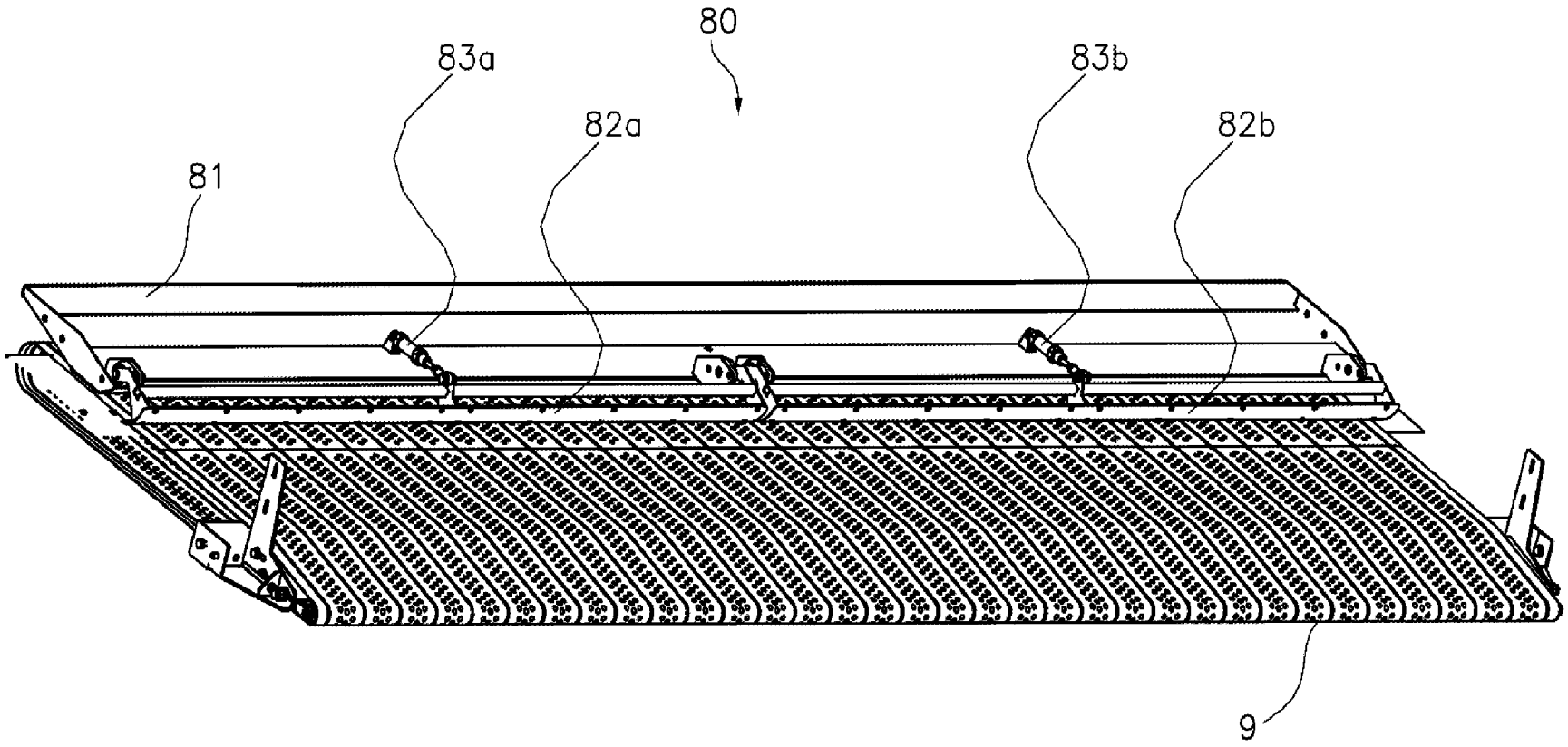
FIG. 12B is a top plan view of the auxiliary device.

FIGS. 11A to 11C are diagrammatic sectional side views of the feeding machine 100 in two different moments of bed sheet spread and unwrinkling operations, the last one intended for avoiding wrinkles on the bed sheet spread between two spreading grippers 7.

FIGS. 11A to 11C show a vacuum chamber 44 that is provided below the spreading grippers 7 and at a lower level than the outgoing feed conveyor 9 and at a distance of a leading edge of said outgoing feed conveyor 9, the vacuum chamber 44 having an entrance 45 facing the front end of the outgoing feed conveyor 9. Both the vacuum chamber 44 and the suction entrance 45 extend all along the outgoing feed conveyor 9 width, and the vacuum chamber 44 is fluidly connected to a vacuum device (not illustrated).

The FIGS. 11A to 11C also show an introducer or swallow roller 46 parallel to the front end of the outgoing feed conveyor 9 that is arranged in front of the suction entrance 45, the introducer roller 46 extending all along the whole outgoing feed conveyor width and being rotated by a motor in a load direction by which an uncovered upper surface of the introducer roller 46 moves towards the suction entrance 45.

These FIGS. 11A to 11C also illustrate another element of the disclosed embodiment concerning a separator blade 59, movable by an actuator 60 in a lifting and lowering motion, the separator blade being operative during the period of time in which a flatwork article 53 is transferred from the spreading grippers 7 onto the outgoing feed conveyor 9.

According to the sequence illustrated in FIGS. 11A to 11C, a flatwork article 53 enters the vacuum chamber 44 by contact with the rotating or introducer roller 46, positioned in front of the vacuum chamber 44. A flatwork article 53 must be hung and stretched out outside the vacuum chamber 44. A separating blade 59 moves vertically to position itself between the bed sheet and the introducer roller 47 (FIG. 11A) in order to prevent contact between these two elements (upper position), for example if in another section of the machine introduction of another flatwork article 53 takes place. When the vacuum chamber is ready to receive a new flatwork article (53), the separating blade 59 moves downwards (low position of FIG. 11B), the flatwork article 53 encounters the introducer roller 46 and enters the vacuum chamber 44. In this embodiment the machine is equipped with 2 independent separating blades, each driven by 2 pneumatic cylinders 60, in order to allow work in 2 half-tracks.

The vacuum chamber 44 further includes a member 37, actuated by a piston 24, that temporally reduces the suction in the vacuum chamber 44 obstructing part of the vacuum chamber 44 section avoiding the entrance of a flatwork article 53 or facilitating the transfer of the flatwork articles 53 onto the conveying surface of the outgoing feed conveyor 9, once the flatwork article 53 has been suctioned into the vacuum chamber (see FIG. 11C).

Therefore, the position of the separating blades 59 and the position of the member 37 temporally prevent the insertion of a spread piece of clothing into the suction entrance 45, in correspondence with any of the above-mentioned several different zones, where the unloading of the flatwork articles 53 can take place towards the conveying surface of the outgoing feed conveyor 9.

Thus, the member 37 obstructs vacuum chamber 44 when the separating blade 59 is in an upper position (FIG. 11A) blocking the access of the flatwork article 53 and once the flatwork article 53 is inside of the vacuum chamber 44, and transfer of the flatwork article 53 onto the conveying surface of the outgoing feed conveyor 9 begins and leaves free the suction when the separating blade 59 is in the lower position letting in the flatwork article.

A controller coordinates the movements of the transferring grippers 6, spreading grippers 7, separating blades 59 and members 37 in order to enable the handling of different flatwork articles 53 in a quicker way.

As previously indicated, in an embodiment the feeding machine further includes an auxiliary device 80 arranged in superposition to the loading end of the outgoing feed conveyor 9 including a roof plate 81 with a pivotable flap articulated to one edge and configured to be driven away from the surface of the feed conveyor 9 or close to it, whereby allowing a controlled passage of the flat clothing article 53 extended on said outgoing feed conveyor 9. In this embodiment the auxiliary device 80 extends transverse to the loading direction of the flatwork article on said outgoing feed conveyor and the articulated pivotable flap is divided in two independent flaps 82*a*, 82*b*, each with its own driving means 83*a*, 83*b* (that can be implemented by pistons or lineal actuators), in correspondence with the two movable separating blades 59. If the feeding machine is equipped with this auxiliary device the referred controller further provides a synchronisation between movements of each separate blade 59 and independent flaps 82*a*, 82*b* of the auxiliary device 80, allowing the machine to operate in two lanes arranged side by side.

What is claimed is:

1. A feeding machine (100) for feeding flatwork articles, such a bed sheet, to a subsequent article treatment machine, the feeding machine (100) including:

a plurality of loading posts (1) each of the posts including a load conveyor (2) comprising a conveying surface movable in a feed direction (D) configured to transfer a leading-edge portion of the flatwork article (53) between leading corner portions thereof to a rear delivery unit (2*b*) of said load conveyor (2);

a pair of transferring grippers (6), movable between a receiving position, adjacent to the rear delivery unit (2*b*) for engagement with the trailing corner portions of the flatwork article (53), and a transfer position spaced apart from the receiving position in the feed direction (D);

a pickup station including at least two spreading grippers (7) which are movable along at least one transverse horizontal guide (8) perpendicular to the feed direction (D) between a waiting position adjacent to said transfer position of the transferring grippers (6), for receiving and griping the trailing corner portions of the flatwork article (53) and a spread position in which the spreading grippers (7) are further separated from each other than in the waiting position;

an outgoing feed conveyor (9) having a front end located below the spreading grippers (7) and a conveying surface movable in the feed direction (D) to transfer the flatwork article (53) into an ironer-dryer machine;

a vacuum chamber (44) connected to a vacuum source, located below the spreading grippers (7) and below the front end of the outgoing feed conveyor (9) and having a suction entrance (45) to the vacuum chamber (44) arranged at a distance of a leading edge of said outgoing feed conveyor (9), and an introducer roller (46) parallel to the front end of the outgoing feed conveyor (9) being rotated by a motor in a load direction and being arranged adjacent the suction entrance;

wherein:

each of the loading posts (1) has one pair of transferring grippers (6) associated to the respective rear delivery unit (2*b*);

the suction entrance (45) of the vacuum chamber (44) and the introducer roller (46) extends all along the outgoing feed conveyor and have associated at least two movable separating blades (59) that are configured to temporally prevent the insertion of a spread piece of clothing hanging from the transferring grippers (6) or from the spreading grippers (7) into the suction entrance (45);

the spreading grippers (7) are mobile independently of each other over the entire width of the transverse horizontal guide (8), so that the flatwork article (53) is widespread either centred in correspondence with a central zone of the outgoing feed conveyor (9) or alternatively in correspondence with one lateral zone thereof, to be unloaded on the outgoing feed conveyor (9) allowing the machine to operate in one or more lanes; and a controller that coordinates the movements of the transferring grippers (6), spreading grippers (7) and movable separating blades (59).

2. The feeding machine (100) according to claim 1, wherein each separating blade (59) is configured to be moved in a vertical direction upwardly to position itself between the flatwork article (53) and the introducer roller (47) at a level in order to prevent contact between these two elements during a first step of transfer of the flatwork article (53) towards the outgoing feed conveyor (9) and each separating blade (59) is configured to be moved downward in a second step of the transfer when the flatwork article (53) is to be transferred so that a free end portion of the spread flatwork article (53) encounters the introducer roller (46) and enters the vacuum chamber 44, an actuator 60 providing these up and down movements of the separating blade (59).

3. The feeding machine (100) according to claim 2, wherein in correspondence with each of the separating blades (59), the vacuum chamber (44) further includes a member (37) driven by an actuator (24) that, by being displaced temporally, reduces the suction in the vacuum chamber (44) obstructing part of the vacuum chamber (44) section, and wherein said controller is further configured to provide a synchronisation between movements of each separating blade (59) and member (37) and a coordination between the movement of different separating blades (59) to operate separately or to operate in conjunction depending on the zone where the flatwork article (53) is centered.

4. The feeding machine (100) according to claim 3, wherein displacement of member (37) obstructs vacuum chamber (44) when the separating blade (59) is in an upper position blocking the access of the flatwork article and once the flatwork article is inside of the vacuum chamber (44), transfer of the flatwork article (53) onto the conveying surface of the outgoing feed conveyor (9) begins and leaves free the suction when the separating blade (59) is in the lower position.

5. The feeding machine (100) according to claim 1, wherein the load conveyor (2) further includes a front reception unit (2*a*) configured to grip between a lower reception endless belt (12) and an upper reception endless belt (13) thereof, a leading-edge portion of the flatwork article (53) between leading corner portions thereof; and wherein:

one pair of guiding channels (3) are located at either side of the rear delivery unit (2*b*) of the load conveyor (2), the guiding channels (3) guiding hanging parts of the flatwork article (53) having respective rear trailing corners; and two pairs of corner-gripping nip rollers (4, 5) located adjacent to the rear delivery ends of the guiding channels (3) adjacent said rear delivery unit (2*b*).

6. The feeding machine (100) according to claim 5, wherein jaws of each of the transfer grippers (6) are mounted on associated ones of a pair of pivot arms (10) each pivotable about a respective ones of pivot axes (11), wherein a pair of the pivot axes (11) associated with a respective pair of the transferring grippers (6) being parallel to each other and determining that movement of both of the pivot arms are coplanar, and the transferring grippers (6) being configured to describe circular arc paths in opposite directions when moving between a receiving position below corner-gripping nip rollers (4, 5) for engagement by gripping trailing corner portions of the flatwork article (53) and the transfer position so that gripped ones of the trailing corner portions of the flatwork article (53) are moved away, and the flatwork article (53) is transversally extended a certain degree while the flatwork article (53) is transferred.

7. The feeding machine (100) according to claim 6, wherein the pivot axes (11) are oriented in a vertical direction and the circular arc paths described by the transferring grippers (6) when moving between the receiving position and the transfer position are comprised in a substantially horizontal plane.

8. The feeding machine (100) according to claim 5, wherein the lower reception endless belt (12) of the front reception unit (2*a*) extends around a horizontal lower reception front pulley (16) and a horizontal lower reception rear pulley (17);

the upper reception endless belt (13) extends around a horizontal upper reception front pulley (18) and a horizontal upper reception rear pulley (19);

the lower reception endless belt (12) is paired with the upper reception endless belt (13) and both have respective drag sections of said leading edge portion of the flatwork article (53) which face each other and move in the feed direction (D);

the lower reception front pulley (16) is mounted on a lower tilting support (54) pivotable about an axis coaxial with the lower reception rear pulley (17);

a spring element (55) is operatively connected to the lower tilting support (54) to bias the lower tilting support (54) to rotate upwards, the lower tilting support (54) being lockable in a desired tilt position by a locking device; and the upper reception front pulley (18) is mounted on an upper tilting support (56) pivotable about an axis coaxial with the upper reception rear pulley (19), the drag section of the upper reception endless belt (13) resting on the drag section of the lower reception endless belt (12) by gravity at any tilt position of the lower tilting support (54).

9. The feeding machine (100) according to claim 8, wherein the rear delivery unit (2*b*) of the load conveyor (2) comprises:

two lower delivery endless belts (14) extending around respective horizontal lower delivery front pulleys (20) and respective horizontal lower delivery rear pulleys (21); and two upper delivery endless belts (15) extending around respective horizontal upper delivery front pulleys (22) and respective horizontal upper delivery rear pulleys (23);

and wherein the lower delivery rear pulleys (21) are at a higher level than the lower delivery front pulleys (20) and the upper delivery front pulleys (22);

each lower delivery endless belt (14) is paired with one of the upper delivery endless belts (15) and both have respective drag sections which face each other and move in the feed direction (D) dragging said leading edge portion of the flatwork article (53);

the pairs of lower and upper delivery endless belts (14, 15) are located at either side of the pair of lower and upper reception endless belts (12, 13); and the lower delivery front pulleys (20) are coaxial with the lower reception rear pulley (17) and the upper delivery front pulleys (22) are coaxial with the upper reception rear pulley (19).

10. The feeding machine (100) according to claim 9, wherein:

the lower reception rear pulley (17) and the lower delivery front pulleys (20) are rigidly attached to a lower front shaft (27);

the lower delivery rear pulleys (21) are rigidly attached to a lower rear shaft (28); the horizontal upper reception rear pulley (19) and the upper delivery front pulleys (22) are rigidly attached to an upper front shaft (29);

the upper delivery rear pulleys (23) are rigidly attached to an upper rear shaft (30); and a single first motor is operatively connected to rotate the lower rear shaft (28) and the upper rear shaft (30) in opposite directions.

11. The feeding machine (100) according to claim 10, wherein each pair of corner-gripping nip rollers (4, 5) comprises:

a stationary corner-gripping roller (4) located adjacent to one of the lower delivery rear pulleys (21) and rotary mounted on the lower rear shaft (28);

a movable corner-gripping roller (5) parallel to the stationary corner-gripping roller (4) and rotary mounted on a roller shaft (32) fixed to a pivot arm (33) pivotally mounted on a pivot shaft (34);

wherein at least one single nip roller motor (35) is operatively connected to rotate the stationary and movable corner-gripping rollers (4, 5) of each pair of corner-gripping nip rollers (4, 5) in opposite directions; and an arm actuator (36) is operatively connected to move the pivot art (33) of each pair of corner-gripping nip rollers (4, 5) between a grip position, in which the movable corner-gripping roller (5) presses against the stationary corner-gripping roller (4), and a release position, in which the movable corner-gripping roller (5) is away from the stationary corner-gripping roller (4).

12. The feeding machine (100) according to claim 11, further comprising:

two corner-detecting sensors 43, each arranged so as to detect the presence of a rear corner of a flatwork article (53) in a space adjacent gripping roller (4).

13. The feeding machine (100) according to claim 1, wherein the spreading grippers comprises three or more grippers, each of them being attached to a continuous belt (61, 62, 70) rotatable around pulleys (65,66, 72) and each one activated by a motor (M1, M2, M3), the continuous belts (61, 62, 70) being parallel to the transversal guide (8).

14. The feeding machine (100) according to claim 1, further comprising:

an auxiliary device (80) placed in superposition to a loading end portion of the outgoing feed conveyor (9) including a roof plate (81) with an articulated pivotable flap configured to be driven away from a surface of the feed conveyor (9) or close to the surface, allowing a controlled passage of the flat clothing article (53) extended on said outgoing feed conveyor (9);

wherein said auxiliary device (80) extends transverse to the loading direction of the flatwork article (53) on said outgoing feed conveyor and the articulated pivotable flap is divided in two independent flaps (82*a*, 82*b*), each of them with its own driving means (83*a*, 83*b*), in correspondence with the two movable separating blades (59), and wherein said controller is further configured to provide a synchronisation between movements of each separate blade (59) and independent flaps (82*a*, 82*b*) of the auxiliary device (80).

15. The feeding machine (100) according to claim 4, further comprising:

an auxiliary device (80) placed in superposition to a loading end portion of the outgoing feed conveyor (9) including a roof plate (81) with an articulated pivotable flap configured to be driven away from a surface of the feed conveyor (9) or close to the surface, allowing a controlled passage of the flat clothing article (53) extended on said outgoing feed conveyor (9);

wherein said auxiliary device (80) extends transverse to the loading direction of the flatwork article (53) on said outgoing feed conveyor and the articulated pivotable flap is divided in two independent flaps (82*a*, 82*b*), each of them with its own driving means (83*a*, 83*b*), in correspondence with the two movable separating blades (59), and wherein said controller is further configured to provide a synchronisation between movements of each separate blade (59) and independent flaps (82*a*, 82*b*) of the auxiliary device (80).

* * * * *